US012262796B2

(12) United States Patent
Ferris

(10) Patent No.: US 12,262,796 B2
(45) Date of Patent: Apr. 1, 2025

(54) CLOTHING CLOSURE AND METHOD OF CONVERTING PEARL INTO CLOTHING CLOSURE

(71) Applicant: Grace Ferris, Riverside, CA (US)

(72) Inventor: Grace Ferris, Riverside, CA (US)

( * ) Notice: Subject to any disclaimer, the term of this patent is extended or adjusted under 35 U.S.C. 154(b) by 329 days.

(21) Appl. No.: 17/867,765

(22) Filed: Jul. 19, 2022

(65) Prior Publication Data

US 2023/0276905 A1 Sep. 7, 2023

Related U.S. Application Data

(60) Provisional application No. 63/317,027, filed on Mar. 6, 2022.

(51) Int. Cl.
*A44B 1/04* (2006.01)
*A44B 1/18* (2006.01)

(52) U.S. Cl.
CPC . *A44B 1/04* (2013.01); *A44B 1/18* (2013.01)

(58) Field of Classification Search
CPC .... A41B 1/04; A41B 1/18; A41B 1/24; A41B 7/02; A41F 1/004; A41D 2300/30
See application file for complete search history.

(56) References Cited

PUBLICATIONS https://www.nakpunar.com/ivory-pearl-buttons-full-ball-1-2-in/ (with customer review posted Jan. 2017) (Year: 2017).*

* cited by examiner

*Primary Examiner* — Moshe Wilensky
(74) *Attorney, Agent, or Firm* — Brennan, Manna & Diamond, LLC

(57) ABSTRACT

The present invention relates to a decorative functional closure device that is sewn into and applied to clothing. In one embodiment, a method of converting cultured pearls from a strand or necklace to the functional closure device is described. The method includes removing a pearl from a strand, drawing a thread through the pearl using a threader from a first side of the pearl, using a wire protector to create a horseshoe or loop shape at the other side of the pearl such that both ends of the thread are sticking out of the first side of the pearl, tying off and trimming the thread ends, and optionally attaching a seed bead, sewing the horseshoe or loop shape to the clothing such that the pearl can be used to pass through a buttonhole for securing one side of the clothing to another side of the clothing.

16 Claims, 5 Drawing Sheets

CLOTHING CLOSURE AND METHOD OF CONVERTING PEARL INTO CLOTHING CLOSURE

CROSS-REFERENCE TO RELATED APPLICATION

The present application claims priority to, and the benefit of, U.S. Provisional Application No. 63/317,027, which was filed on Mar. 6, 2022, and is incorporated herein by reference in its entirety.

FIELD OF THE INVENTION

The present invention relates generally to the field of clothing and buttons for clothing. More specifically, the present invention relates to a novel functional closure device and a method of forming the functional closure device from cultured pearls of a strand or necklace. The closure device includes a pearl through which a thread is drawn such that a horseshoe or loop shape of the thread is formed on one side of the pearl and free ends of the thread stick out of the other side of the pearl. The horseshoe or loop shape is sewn to a garment allowing the pearl to pass through a buttonhole to secure the clothing. Accordingly, the present disclosure makes specific reference thereto. Nonetheless, it is to be appreciated that aspects of the present invention are also equally applicable to other like applications, devices, and methods of manufacture.

BACKGROUND

By way of background, individuals may buy and wear different kinds of clothes in order to remain updated with the latest fashion. With time, the clothes may get old and may not match up with the changing fashion trends. With the change in fashion, individuals may need new clothes so as to be stylish and therefore, may have to discard the old clothes as the old ones become unusable and/or outdated with changing fashion. The closure styles such as buttons and the like of the clothes may also change with time, which can also make the clothes look old or outdated. Old buttons and closures can be unattractive, damaged, and/or outdated, that degrades the overall look of the clothes as well.

Individuals may need to frequently buy new articles of clothing for updated fashions which can be cost prohibitive for many. Further, the old clothes represent a significant investment and individuals may be reluctant to discard them easily as well. Furthermore, discarding old or outdated clothing isn't always feasible. Individuals may desire to enhance or modify the look of their old clothes with minimal changes to the clothing.

Accessories such as pearls, beads, and more can be used in clothing, that quickly adds a level of elegance to any outfit and ensures the outfit looks updated with the latest fashion trends. Individuals can easily find a string of cultured pearls and other similar accessories at their home, in any drawer, jewelry box, etc. that likely have been unused for years or decades. Such pearls, beads, etc. may have remained unused for a long period of time and may not be worn ever by the individuals owning them. Individuals may desire to use such jewelry/accessories in some functional manner as well.

Therefore, there exists a long felt need in the art for a method of updating old outfits in order to match up with the latest trends. There is also a long felt need in the art for a method of creating styled closures for outfits that ultimately enhances the look of the outfits of the individuals. Additionally, there is a long felt need in the art for a styled button for outfits that can be easily mounted to the clothes and that quickly changes the look of the old clothes. Moreover, there is a long felt need in the art for a stylish closure for clothes that eliminates the need to buy new clothes in order to be stylish and updated. Further, there is a long felt need in the art for a stylish button that ensures updated outfits for individuals and obviates the need for individuals to spend money on buying new clothes. Furthermore, there is a long felt need in the art for a stylish closure for clothing that obviates the discarding of costly old clothes and makes it easy to enhance the look of clothing with minimal changes. There is a long felt need in the art for stylish closure alternatives that can be manufactured using pearl jewelry or the like. Finally, there is a long felt need in the art for a stylish closure alternative that is budget friendly and that does not require much effort in changing the look of old clothes.

The subject matter disclosed and claimed herein, in one embodiment thereof, comprises a method of forming a functional closure device for clothing from a cultured pearl. The method can be used for conversion of cultured pearls from a strand or necklace to the functional closure device for improving or replacing old buttons or closures and thereby creating a more stylish article of clothing. The method includes the steps of drawing, using a threader, a thread through the cultured pearl from a first hole to a second hole; creating, using a wire thread protector, a horseshoe or loop shape of the thread at the second hole; drawing, the thread back through the pearl to the first hole such free ends of the thread stick out of the first hole; sewing the pearl to a first side of a garment by sewing the horseshoe or loop shape of the thread to the garment; and, passing the pearl through a buttonhole to secure the first side of the garment to a second side of the garment wherein the buttonhole is disposed on the second side of the garment.

In the manner described supra, the method of manufacturing a functional closure device of the present invention accomplishes all of the forgoing objectives and provides users a method of conversion of cultured pearls from a strand or necklace to a functional closure feature that is sewn into and applied to clothing. The method and the closure device enables practical use of old jewelry and artistically improves an item of old clothing that may not otherwise be worn. The method helps in improving or replacing old buttons or closures and creates a more stylish article of clothing in a cost-effective and convenient way.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a method of forming a functional closure device for clothing from a cultured pearl. The method includes the steps of drawing, using a threader, a thread through the cultured pearl from a first hole to a second hole; creating, using a wire thread protector, a horseshoe or loop shape of the thread at the second hole; drawing, the thread back through the pearl to the first hole such free ends of the thread stick out of the first hole; sewing the pearl to a first side of a garment by sewing the horseshoe or loop shape of the thread to the garment; and, passing the pearl through a buttonhole to secure the first side of the garment to a second side of the garment wherein the buttonhole is disposed on the second side of the garment.

In yet another embodiment, the free ends sticking out of the pearl are tied off or trimmed using a pair of scissors.

In yet another embodiment, an ornamental bead is fastened to the free ends sticking out of the pearl.

In yet another embodiment, the method further includes removing the wire thread protector after creating the horseshoe or loop shape.

In yet another embodiment, an aesthetically appealing and decorative functional closure device for a garment is disclosed. The functional closure device includes a cultured pearl having a pair of opposing holes, a thread drawn from a first of the opposing holes to a second of the opposing holes, a horseshoe or loop shape created using the thread extending from the second hole, a decorative bead attached to the first hole using free ends of the thread wherein the horseshoe or loop shape is sewn to a garment enabling the pearl to pass through a buttonhole to secure one side of the garment to other side of the garment.

In yet another embodiment, a kit for converting cultured pearls from a strand or necklace to a functional closure feature that is sewn into and applied to clothing is disclosed. The kit includes a nylon thread, a needle threader, a wire thread protector, and a pair of scissors. The nylon thread is configured to be drawn through the pearl using the needle threader, the wire thread protector is used for forming a horseshoe or loop shape at the side of the pearl opposite to the side from which the thread is drawn, and the pair of scissors is used for trimming the free ends of the thread. The horseshoe or loop shape of the thread is sewn to a garment allowing the pearl to pass through a buttonhole to secure one side of the clothing to the other side of the clothing.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
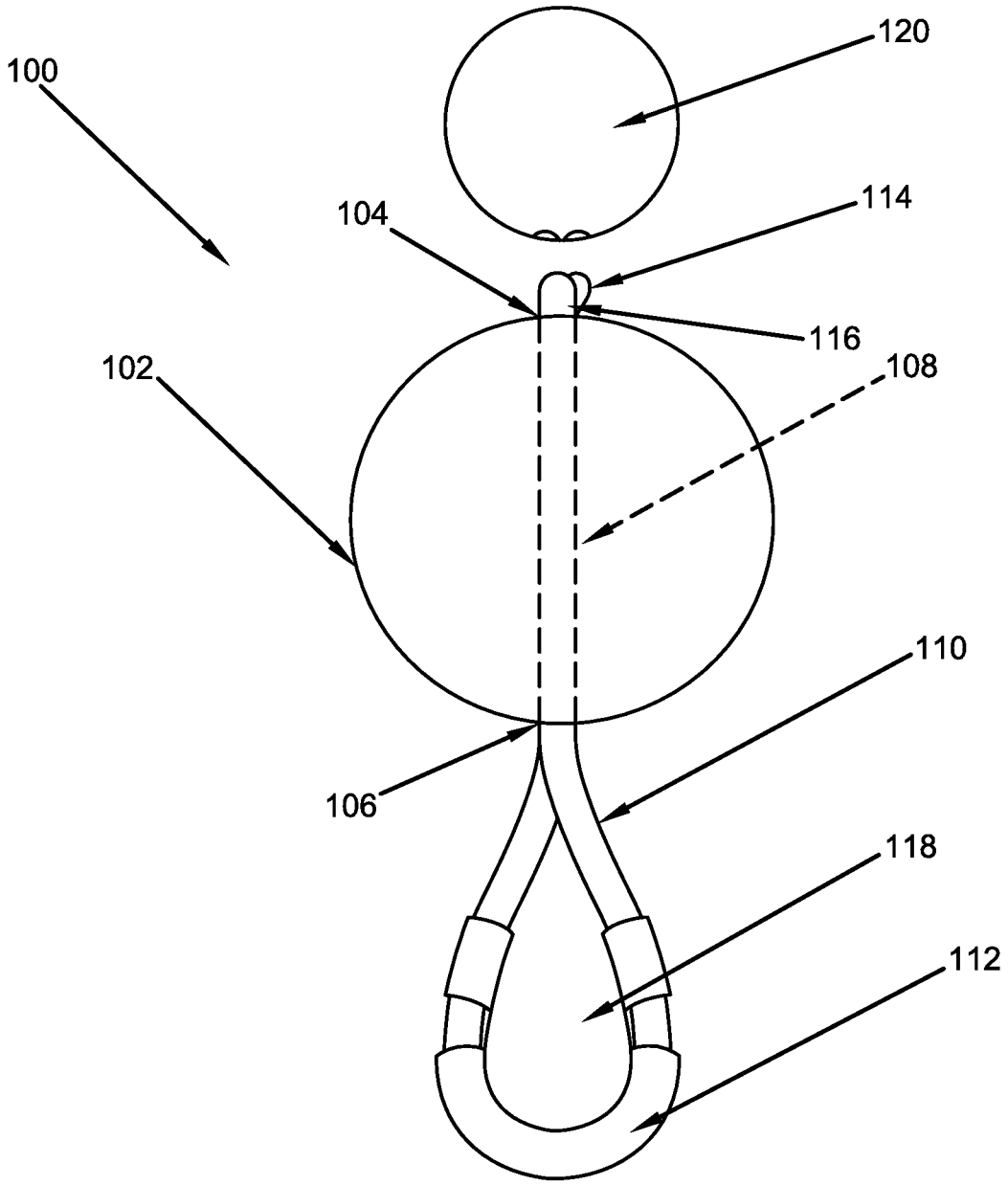
FIG. 1 illustrates a perspective view of one potential embodiment of a functional closure device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a method of updating old outfits in order to match up with the latest trends. There is also a long felt need in the art for a method of creating styled closures for outfits that ultimately enhances the look of the outfits of the individuals. Additionally, there is a long felt need in the art for a styled button for outfits that can be easily mounted to the clothes and that quickly changes the look of the old clothes. Moreover, there is a long felt need in the art for a stylish closure for clothes that eliminates the need to buy new clothes in order to be stylish and updated. Further, there is a long felt need in the art for a stylish button that ensures updated outfits for individuals and obviates the need for individuals to spend money on buying new clothes. Furthermore, there is a long felt need in the art for a stylish closure for clothing that obviates the discarding of costly old clothes and makes it easy to enhance the look of clothing with minimal changes. There is a long felt need in the art for stylish closure alternatives that can be manufactured using pearl jewelry or the like. Finally, there is a long felt need in the art for a stylish closure alternative that is budget friendly and that does not require much effort in changing the look of old clothes.

The present invention, in one exemplary embodiment, is a kit for converting cultured pearls from a strand or necklace to a functional closure feature that is sewn into and applied to clothing. The kit includes one or more spools of nylon thread, at least one needle threader, at least one wire thread protector, and a pair of scissors. The nylon thread is configured to be drawn through the pearl using the needle threader. The wire thread protector is used for forming a horseshoe or loop shape at the side of the pearl opposing to the side from which the thread is drawn, and the pair of scissors is used for trimming the free ends of the thread. The horseshoe or loop shape of the thread is sewn to a garment allowing the pearl to pass through a buttonhole to secure one side of the clothing to the other side of the clothing.

Referring initially to the drawings, FIG. 1 illustrates a perspective view of one potential embodiment of a functional closure device 100 of the present invention in accordance with the disclosed architecture. The functional closure device 100 of the present invention is a novel functional closure device made from a cultured pearl. Any pearl from old jewelry, pearl strands, and/or pearl necklaces can be converted into the functional closure device 100 of the present invention in accordance with the present invention. More specifically, the closure device 100 includes a cultured pearl 102 having a pair of opposing holes 104, 106 forming an internal hollow channel 108 through the pearl 102. The holes 104, 106 are used for stranding the pearl 102 through a jewelry article.

The closure device 100 further includes a thread 110 which is drawn through the first hole 104 using the free end 116 and passed through the internal channel 108 such that the free end 116 of the thread 110 comes out of the second hole 106. A wire thread protector 112 is positioned at the second hole 106 and is used for creating a horseshoe or loop shape 118 of the portion of the thread 110 coming out of the second hole 106. The free end 116 is passed through the thread protector 112 and is passed vertically upwards through the channel 108 to extend out back from the first hole 104. The two free ends 114, 116 of the thread 110 can be tied off, trimmed, or used for attaching an ornamental piece 120 like a seed bead.

The horseshoe or loop shape of the thread formed by the thread protector 112 can be used for sewing the functional closure device 100 to any garment such that the pearl 102 can be used as a closure with a buttonhole. The closure device 100 can be used with any type of garment like shirts, trousers, coats, windbreakers, suits, sweaters, DIY accessories, and accessories for decoration.

The functional closure 100 can be made from pearl of any shape and design. The advantage of the functional closures is that it covers and securely holds a garment while providing aesthetic appeal to the garment. The functional closure 100 of the present invention can replace conventional buttons of garments and are more resilient and beautiful.

Figure 2:
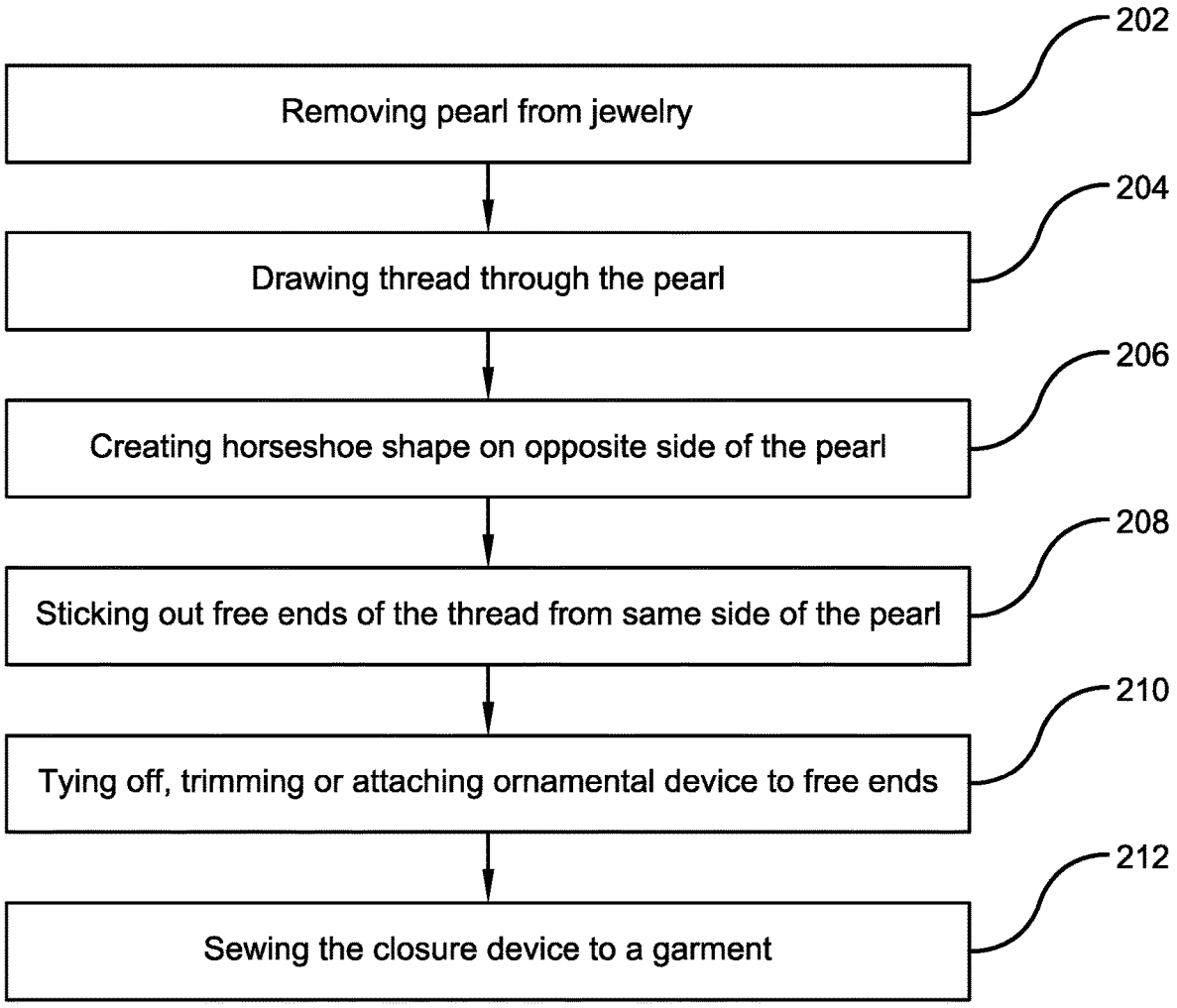
FIG. 2 illustrates a flow chart depicting a process of manufacturing functional closure device of the present invention from the cultured pearl of a necklace in accordance with the disclosed architecture.

FIG. 2 illustrates a flow chart depicting a process of manufacturing the functional closure device of the present invention from the cultured pearl of a necklace in accordance with the disclosed architecture. Initially, a pearl is removed from a strand, necklace, or jewelry item (Step 202). Then, a thread is drawn through the pearl across a pair of holes and a channel therebetween (Step 204). The thread can be drawn using a threader or any other similar device. Then, a horseshoe or loop shape is created at the side opposing to the side of the pearl from where the thread is drawn through the pearl wherein the horseshoe or loop shape is created by passing the thread through a thread wire protector (Step 206). Next, the free end of the thread is again passed through the pearl in opposing direction such that both free ends of the thread are extending out of the same side of the pearl (Step 208). Thereafter, both the free ends can be tied off, trimmed, or can be fastened to a seed bead or similar (Step 210). Finally, the horseshoe or loop end of the pearl is sewn to a garment to use the pearl as a functional closure device or button for the garment (Step 212). It may also be glued to a garment if applied for purely decorative purposes.

It should be noted that after achieving the horseshoe or loop shape of the thread, the thread wire protector can be removed from the pearl and the thread can be released therefrom.

Figure 3B:
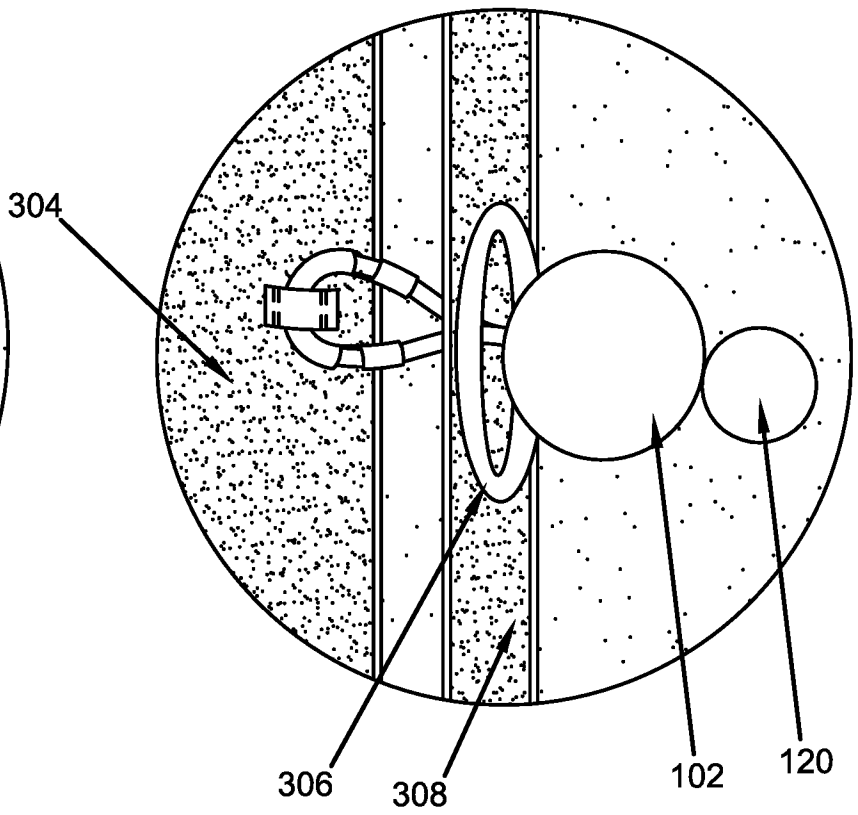
FIG. 3B illustrates the functional closure device passing through a button hole for configuring the device to be used as a button in accordance with the disclosed architecture.
Figure 3A:
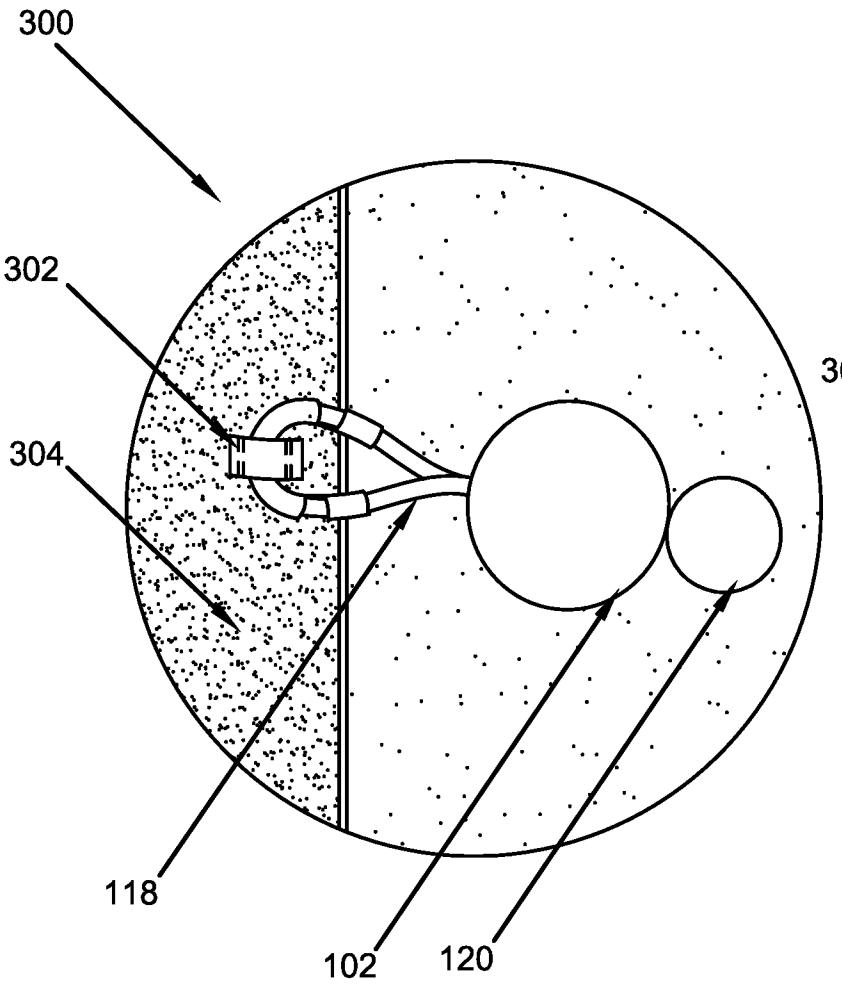
FIG. 3A illustrates a perspective view of the functional closure device sewn to a garment in accordance with the disclosed architecture.

FIG. 3A illustrates a perspective view of the functional closure device 100 sewn to a garment in accordance with the disclosed architecture. As illustrated, for fastening a portion of garment 300 using the closure device 100, the horseshoe or loop shape portion 118 is sewn to the one piece 304 of the garment 300 using any fastening means like a sewing thread 302. Once sewn, the pearl 102 and the optionally attached bead 120 are accessible to a user for engaging with a button hole of the garment 300. Further, the pearl 102 hides the sewing thread 302 and even the horseshoe or loop shape portion 118 underneath thereof and thus provides a clean look to the closure device 100.

FIG. 3B illustrates the functional closure device 100 passing through a buttonhole for configuring the device 100 to be used as a button in accordance with the disclosed architecture. As illustrated, the pearl 102 along with the bead 120 passes through the buttonhole 306 for allowing one piece 304 of the garment 300 to secure to the other piece 308 of the garment 300. The pearl 102 functions as a button and secures to the buttonhole 306 without releasing therefrom unless pulled by a user.

Figure 4:
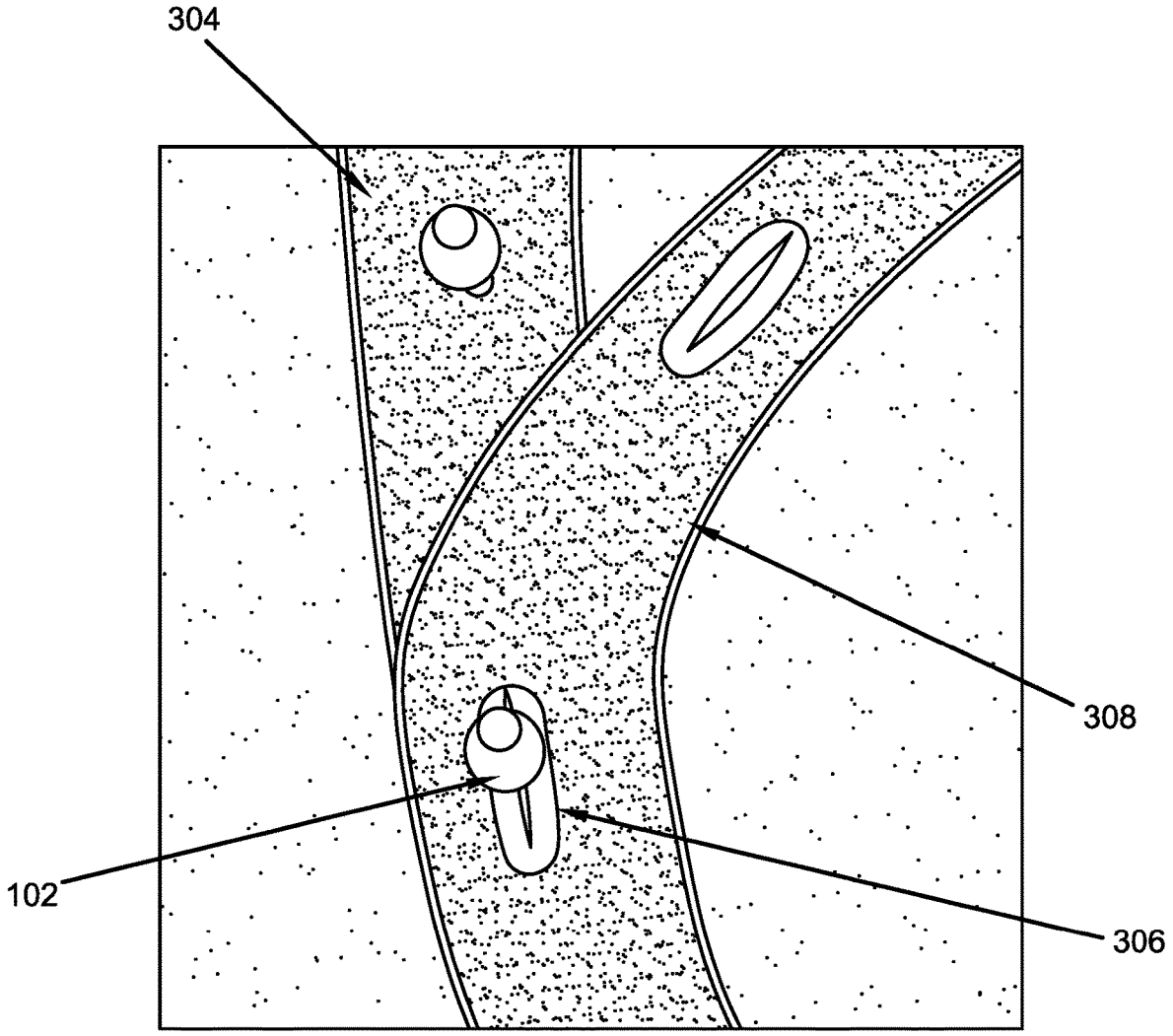
FIG. 4 illustrates a perspective view of the garment with a plurality of functional closure devices of the present invention sewn thereon in accordance with the disclosed architecture.

FIG. 4 illustrates a perspective view of the garment with a plurality of functional closure devices of the present invention sewn thereon in accordance with the disclosed architecture. For improving old buttons or closures and providing a more stylish look to the garment 300, the old buttons are replaced with the closure device 100 of the present invention. As illustrated, one of the closure devices passes through the buttonhole 306 to secure one side 304 of the garment 300 to the second side 308 of the garment 300. Based on the preference of a wearer, one or more closure devices can remain unfastened like conventional buttons of garments.

Figure 5:
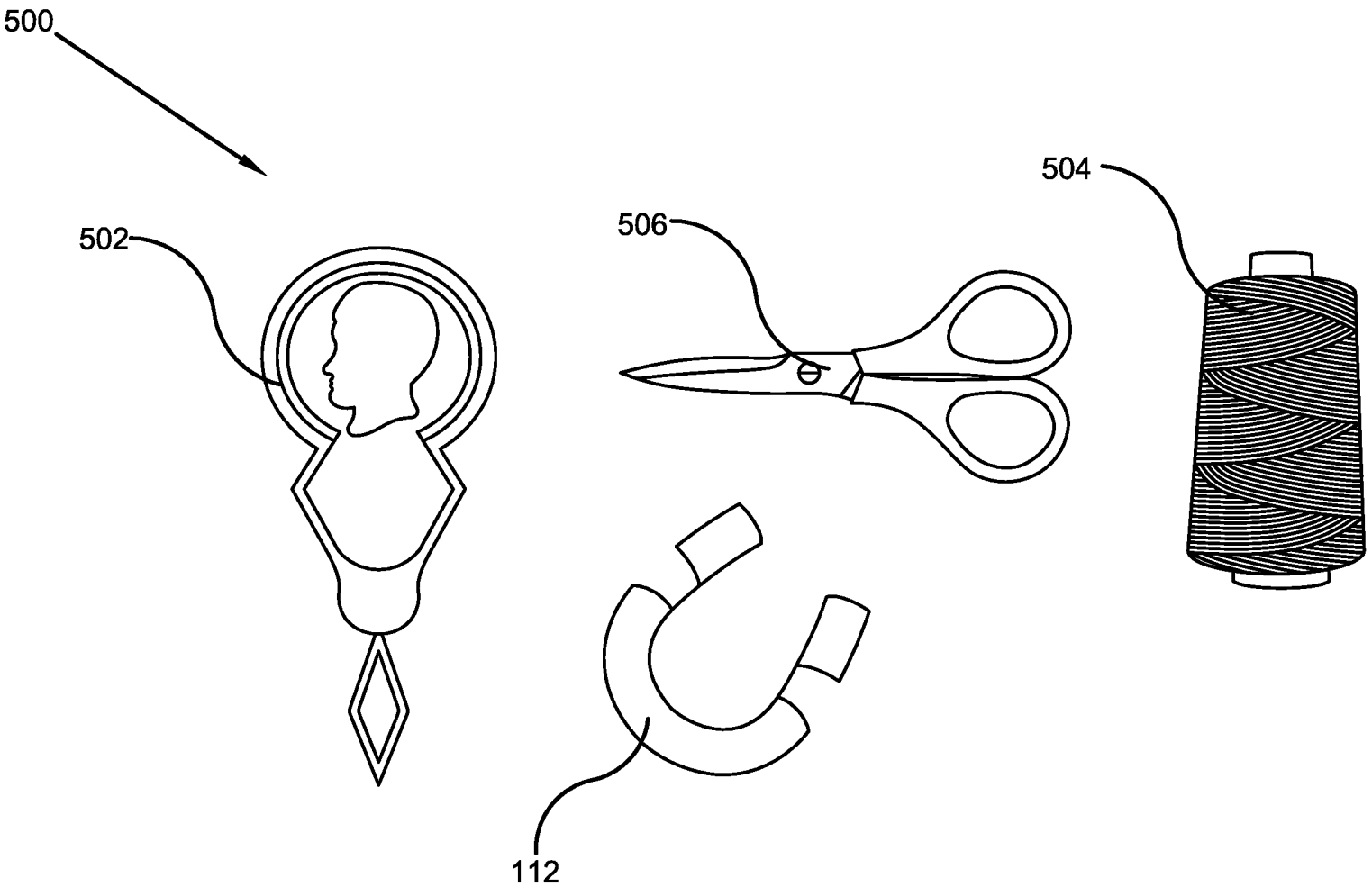
FIG. 5 illustrates a functional closure device making kit used for converting a cultured pearl into the functional closure device of the present invention in accordance with the disclosed architecture.

FIG. 5 illustrates a functional closure device making kit used for converting a cultured pearl into the functional closure device of the present invention in accordance with the disclosed architecture. In the present embodiment of the invention, the kit 500 provides necessary supplies for converting a pearl into closure device of the present invention. The kit 500 can be commercially available over the counter for consumers to buy. The kit 500 comprises a needle threader 502 for drawing the thread 504 through a pearl. The thread 504 can be made of any durable and soft material like nylon and can be available in a variety of colors and materials. A pair of scissors 506 is provided to cut off or trim the free ends of the thread drawn through a pearl. The scissors 506 can also be used for removing the sewn thread used for sewing the closure device to a garment. At least one wire thread protector 112 is used for providing the horseshoe or loop shape to the thread enabling a user to easily sew the pearl to the garment for using as a closure device to pass through a buttonhole.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "functional closure device", "closure device", "decorative closure device", and "pearl button" are interchangeable and refer to the functional closure device 100 of the present invention.

Notwithstanding the forgoing, the functional closure device 100 of the present invention can be of any suitable size and configuration as is known in the art without affecting the overall concept of the invention, provided that it accomplishes the above stated objectives. One of ordinary skill in the art will appreciate that the functional closure device 100 as shown in the FIGS. are for illustrative purposes only, and that many other sizes and shapes of the functional closure device 100 are well within the scope of the present disclosure. Although the dimensions of the functional closure device 100 important design parameters for user convenience, the functional closure device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of converting a pearl into a clothing closure, the method comprising the steps of:

removing a pearl from a jewelry strand of pearls;

drawing a first thread end into a first hole of said pearl, through a channel of said pearl, and out a second hole of said pearl, wherein said channel aligned between said first hole and said second hole;

passing said thread through a thread wire protector;

looping said thread and said thread wire protector proximal to said second hole;

drawing said first thread end into said second hole of said pearl, through said channel of said pearl, and out of said first hole of said pearl;

attaching said first thread end to a second thread end;

fastening said thread wire protector to a first clothing edge aligned with a buttonhole on a second clothing edge; and passing said pearl through said buttonhole for holding said first clothing edge adjacent to said second clothing edge.

2. The method of claim 1, wherein said drawing comprises a threader.

3. The method of claim 1 further comprising a step of attaching a bead to said first thread end and said second thread end.

4. The method of claim 1, wherein said fastening comprises sewing.

5. The method of claim 1, wherein said fastening comprises gluing.

6. The method of claim 3, wherein said fastening comprises sewing.

7. The method of claim 3, wherein said fastening comprises gluing.

8. The method of claim 1 further comprising a step of pulling said pearl through said buttonhole for releasing said first clothing edge from said second clothing edge.

9. The method of claim 1, wherein the clothing is selected from a group consisting of a shirt, a trouser, a coat, a windbreaker, a suit, a sweater, and a DIY accessory.

10. A method of using a clothing closure kit to form a clothing closure, the method comprising the steps of:

providing a kit having a needle threader, thread, a pair of scissors, and a thread wire protector;

removing a pearl from a jewelry strand of pearls;

drawing a first thread end with said needle threader into a first hole of said pearl, through a channel of said pearl, and out a second hole of said pearl, wherein said channel aligned between said first hole and said second hole;

passing said thread through said thread wire protector;

looping said thread and said thread wire protector proximal to said second hole;

drawing said first thread end with said needle threader into said second hole of said pearl, through said channel of said pearl, and out of said first hole of said pearl;

tying said first thread end to a second thread end;

trimming with said pair of scissors said first thread end and said second thread end; and fastening said thread wire protector to a first clothing edge aligned with a buttonhole on a second clothing edge.

11. The method of claim 10 further comprising a step of passing said pearl through said buttonhole for holding said first clothing edge adjacent to said second clothing edge.

12. The method of claim 10 further comprising a step of attaching a bead to said first free end and said second free end.

13. The method of claim 11, wherein the clothing is selected from a group consisting of a shirt, a trouser, a coat, a windbreaker, a suit, a sweater, and a DIY accessory.

14. The method of claim 11, wherein said fastening comprises the step of sewing.

15. The method of claim 11, wherein said fastening comprises the step of gluing.

16. The method of claim 14 further comprising a step of pulling said pearl through said buttonhole for releasing said first clothing edge from said second clothing edge.

* * * * *